United States Patent [19]

Goehle et al.

[11] Patent Number: 4,698,609

[45] Date of Patent: Oct. 6, 1987

[54] MAGNETIC TRIPPING DEVICE

[75] Inventors: Rolf Goehle, Leimen; Volker Schmitt, Bammental; Werner Bruckner, Walldorf; Klaus Greefe, Heidelberg, all of Fed. Rep. of Germany

[73] Assignee: Brown, Boveri & CIE AG, Mannheim, Fed. Rep. of Germany

[21] Appl. No.: 858,210

[22] Filed: Apr. 30, 1986

[30] Foreign Application Priority Data

Apr. 30, 1985 [DE] Fed. Rep. of Germany ..... 3515530

[51] Int. Cl.[4] ..... H01F 7/08

[52] U.S. Cl. ..... 335/255; 335/262; 335/270

[58] Field of Search ..... 335/202, 251, 255, 278, 335/262, 270

[56] References Cited

U.S. PATENT DOCUMENTS 3,837,618 9/1974 Juhel ..... 335/255

FOREIGN PATENT DOCUMENTS 2922148 4/1980 Fed. Rep. of Germany ..... 335/255

568867 4/1945 United Kingdom ..... 335/255

*Primary Examiner*—George Harris

*Attorney, Agent, or Firm*—Herbert L. Lerner; Laurence A. Greenberg

[57] ABSTRACT

A magnetic tripping device for an electrical wiring device includes a U-shaped magnetic yoke, a cylindrical non-magnetic coil form having two end surfaces and a periphery and being disposed in the magnetic yoke, a magnetic core disposed in the coil form, a magnetic armature movably disposed in the coil form, and a compression spring disposed in the coil form between the magnetic core and the magnetic armature, the coil form having at least two radial embossings uniformly distributed over the periphery in the vicinity of the end surfaces for fixing the magnetic core in place in the coil form and for guiding the magnetic armature in the coil form with a limited stroke and a sliding fit.

11 Claims, 9 Drawing Figures

Fig. 1
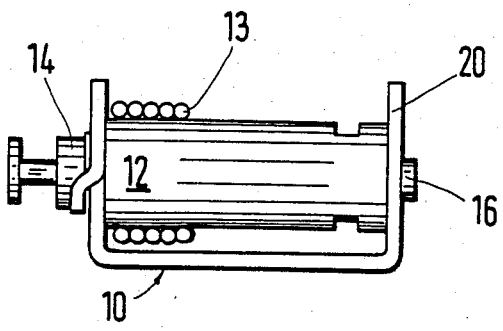
Fig. 2
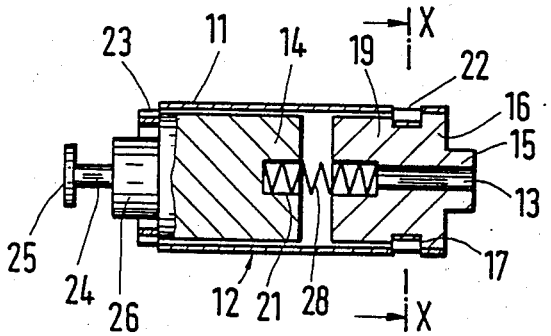
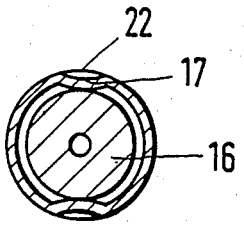
Fig. 3
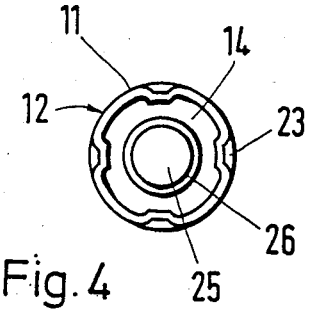
Fig. 4
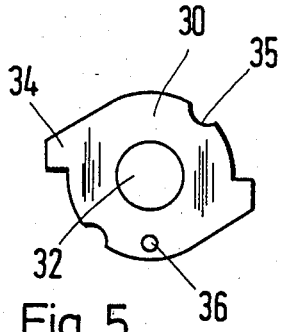
Fig. 5
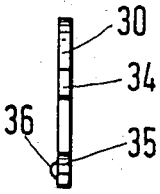
Fig. 6
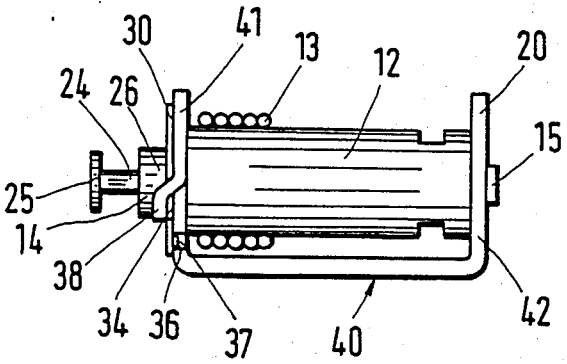
Fig. 7
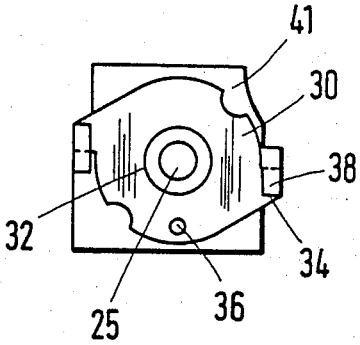
Fig. 8

MAGNETIC TRIPPING DEVICE

The invention relates to a magnetic tripping device for an electrical wiring device, especially for a line protection switch, including a cylindrical coil form being formed of non-magnetic material, preferably light metal, which accommodates a magnetic core, a movable magnetic armature, as well as a compression spring disposed therebetween, and a U-shaped magnetic yoke into which the coil form is inserted.

Magnetic tripping devices which are used in line protection switches are provided for striking a movable contact lever as well as for tripping a locking cam in the event of a short circuit.

Such a magnetic tripping device is known from German Published, Non-Prosecuted Application DE-OS No. 25 31 215. The device includes a coil form for the coil, which responds in the event of a short circuit and is formed of a plastic part which is closed at one end surface except for an opening for the passage of a percussion armature, while being completely open at the other surface. Radially outwardly pointing projections are provided on the closed side for snapping the coil form onto the magnetic yoke. The assembly of this magnetic tripping device is made more difficult by the fact that the magnetic yoke and the coil form with the magnetic core and the magnetic armature as well as a spring are not provided as a structural unit, but instead are individual loose parts which can only be assembled with some effort. The danger of one of the individual parts becoming lost always exists.

Another magnetic tripping device has become known from German-Published, Non-Prosecuted Application DE-OS No. 33 10 914. In that device, the magnetic core and the magnetic armature which are aligned axially and are kept separate by means of a compression spring, are held by a coil form which surrounds them in the form of a cylindrical sheet metal part of non-magnetic material. In order to protect against sliding out of the coil form, straps which are formed at its ends are bent over after the magnetic core, the magnetic armature and the spring are inserted. It should be noted that the magnetic core is fixed, i.e. immovable, while the magnetic armature must have enough play for axial sliding.

The production steps required for this device are therefore rather elaborate and complicated since even in the case of slight displacements of the bending tool, for instance, secure fixation of the parts is no longer assured. There is a further problem, which is the danger that the bent straps which limit the stroke of the movable armature are heavily stressed by frequent switching or chattering of the armature, so that there is a danger of fracture.

It is accordingly an object of the invention to provide a magnetic tripping device which overcomes the hereinafore-mentioned disadvantages of the heretofore-known devices of this general type, which is easy to produce and which can withstand the occurring stresses without difficulty and without adverse effects on its operability.

With the foregoing and other objects in view there is provided, in accordance with the invention, a magnetic tripping device for an electrical wiring device, especially for a line protection switch, comprising a U-shaped magnetic yoke, a cylindrical non-magnetic, preferably light metal, coil form having two end surfaces and a periphery and being disposed in the magnetic yoke, a magnetic core disposed in the coil form, a magnetic armature movably disposed in the coil form, and a compression spring disposed in the coil form between the magnetic core and the magnetic armature, the coil form having means in the form of at least two radial embossings uniformly distributed over the periphery in the vicinity of the end surfaces for fixing the magnetic core in place in the coil form and for guiding the magnetic armature in the coil form with a limited stroke and a sliding fit.

In accordance with another feature of the invention, the magnetic core has a circular slot formed therein in which the at least one embossing is engaged.

After the assembly of the magnetic armature, the magnetic core and the compression spring therebetween which pushes the armature and the core apart, the conventional coil form formed of non-magnetic sheet metal is provided with radial formations which engage corresponding recesses in the core and narrow down the cylindrical space, so that the magnetic core is firmly connected to the coil form and the magnetic armature is limited as to its stroke. For this purpose, at least two embossings are provided at each end which are uniformly distributed over the periphery, i.e. in the case of two embossings they are diametrically opposite each other; a larger number of embossings may be uniformly distributed over the periphery. Two embossings which are provided at a distance from the cylindrical end of the coil form and rest parallel to each other against the assembled magnetic core in the form of a secant, are sufficient for fixing the magnetic core in place. At the end of the coil form on the armature side, i.e. the end at which the stepped magnetic armature projects with its pin-like end from the coil form, the embossings are disposed directly at the end of the tubular coil form in such a manner that the inner boundary surfaces of the embossings lie along a circle concentrically relative to the outside diameter of the coil form, the diameter of the circle being at least large enough so that the pin-shaped end of the magnetic armature strikes against the opening without making contact.

In accordance with an added feature of the invention, the magnetic yoke has a leg with a recess formed therein, and the magnetic core has a first end surface with a central guide hole formed therein for receiving the compression spring and a second end surface opposite the first surface having a post formed thereon form-lockingly engaged in the recess.

In accordance with an additional feature of the invention, the magnetic armature has a first end surface having an offset step formed therein forming a tapered pin, a circular disc integral with the pin forming a tripping part, and a second end surface opposite the first end surface having a recess formed therein for receiving the compression spring, the compression spring having a positioning force matched to a given tripping current intensity for the magnetic tripping device.

In order to join the coil form to the U-shaped magnetic yoke into which it is inserted, the legs of the yokes each have drill holes so that on one hand, the coil form is plugged with the armature-side end flush with the outside surface in the holes and on the other hand the magnetic core surrounded by the coil form is riveted by a way of a riveting extension to the other yoke leg.

In accordance with a further feature of the invention, the reinforced compression spring has a given larger positioning force acting on the magnetic armature for a tripping current intensity of a given magnitude, and including a pressure washer disposed outside or ahead of the coil form and form-lockingly connected to the magnetic yoke for absorbing part of the positioning force and conducting forces transmitted by the magnetic armature to the magnetic yoke.

In accordance with again another feature of the invention, the magnetic yoke has a leg in the vicinity of the magnetic armature, the coil form has an end surface in the vicinity of the magnetic armature, and the pressure washer rests directly against the end face flush with the leg and has a hole formed therein through which the tripping part projects from the coil form.

In accordance with again an added feature of the invention, the leg has two bayonet catches formed thereon, and the pressure washer has two radial projections formed thereon engaging behind or beyond the bayonet catches upon rotation of the pressure washer about the longitudinal axis of the hole formed therein, forming a bayonet latch.

In accordance with again an additional feature of the invention, the pressure washer is a circular disc with mutually parallel planar surfaces and the cutout is substantially centered in the disc.

In order to provide a higher capacity of the magnetic tripping device, i.e. for reliable operation in case of larger short circuit currents, an appropriately stronger compression spring is used instead of the normal compression spring. To take up positioning forces resulting therefrom, which are transmitted to the magnetic armature, a pressure disc provided with a central through-hole is placed axially on the magnetic armature projecting from the yoke leg and is secured by means of a bayonet-type closure.

The hole in the compression disc is provided in such a way that the pin-shaped stepped end of the magnetic armature rests with a ring-shaped step directly on the pressure disc without axial play.

The bayonet closure is constructed in such a way that two radially outwardly-pointing projections formed at the pressure disc extend behing two hooks or ring straps upon turning the disc about the axis of the hole, the hooks or ring straps being formed at the yoke leg in opposite directions corresponding to the sense of rotation.

In accordance with still another feature of the invention, the pressure washer has a safety dog formed on at least one surface thereof engaging in a recess formed in the leg of the magnetic yoke for this purpose, when the pressure washer is latched to the magnetic yoke.

In order to protect against unintended or automatic loosening or detaching of the pressure or thrust washer, the washer is provided with a point-shaped formation which protrudes from the disc plane and, in the locked position, engages an associated hole in the yoke leg and serves as a snap-in security device. For simpler handling, it is advisable to construct the thrust or pressure washer with mirror symmetry, i.e. point symmetry with respect to the shape of the locking projections and the securing cams.

In accordance with a concomitant feature of the invention, the embossing is an annular flange. The radial embossing at the armature side end of the sheet metal jacket may be an annular flange in order to limit the stroke of the axially movable magnetic armature, wherein its pin-shaped stepped-off end penetrates the remaining opening without play.

Other features which are considered as characteristic for the invention are set forth in the appended claims.

Although the invention is illustrated and described herein as embodied in a magnetic tripping device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments, when read in connection with the accompanying drawings, in which:

FIG. 1 is a diagrammatic, side-elevational view of a magnetic tripping device according to the invention;

FIG. 2 is a side-elevational view of a coil form, partly broken away in a longitudinal section;

FIG. 3 is a cross-sectional view of the coil form, taken along the line X—X in FIG. 2, in the direction of the arrows;

FIG. 4 is an elevational view of the end face of the coil form on the armature side;

FIG. 5 is an elevational view of a pressure washer;

FIG. 6 is a side-elevational view of the pressure washer;

FIG. 7 is a view similar to FIG. 1 of a magnetic tripping device with a pressure washer according to the invention which has been inserted;

FIG. 8 is an elevational view of the end face of the magnetic tripping device on the armature side, with the pressure washer inserted.

Figure 9:
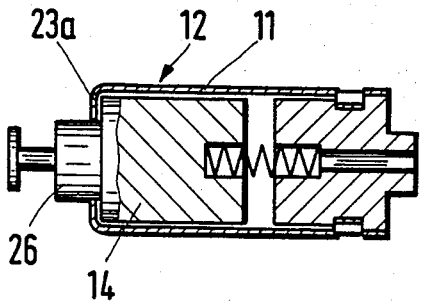
FIG. 9 is a view similar to FIG. 2 of a coil form with a flange at one end.

Referring now to the figures of the drawings in detail and first, particularly, to FIG. 1 thereof, there is seen an assembly in the form of a magnetic tripping device 10 according to the invention, formed of a magnetic yoke 20 into which a coil form 12 is inserted. The coil form 12 is surrounded by a magnet coil 13. As shown in FIG. 2, the interior of the coil form 12 contains a movably guided magnetic armature 14 and a magnetic core 16 on the opposite side of the coil form 12. Further details concerning this construction can also be seen from FIG. 2.

FIG. 2 shows a coil form 12 which is formed by a sheet metal jacket 11 formed of non-magnetic material, preferably an aluminum alloy. The coil form 12 is cylindrical and the magnetic armature 14 and magnetic core 16 are mutually aligned in the interior thereof. The magnetic core 16 has a circular slot 17 formed in the periphery thereof into which the sheet metal jacket 11 of the coil form 12 is embossed at two points. These embossings 22 are diametrically opposite each other and provide a connection between the sheet metal jacket 11 and the magnetic core 16. A post 15 which is formed at an end face of the magnetic core 16 pointing out of the coil form, surrounds a central through-hole 13. The opposite end face of the core 16 has a guide hole 19 formed therein which contains a compression spring 28. The compression spring 28 is braced against the fixed magnetic core and is engaged in a recess 21 formed in the magnetic armature 14. The end face of the magnetic armature 14 opposite the compression spring 28, is offset in step fashion. Embossings 23 are formed at the very end of the tubular coil form 10, are uniformly distributed over the periphery thereof and are disposed opposite each other in pairs. A pin, cam or dog 26 protrudes through the remaining opening and is continued in a pin 24. A disc 25 which is formed at the end of the pin 24, works together with the pin 24 and forms a tripping part.

FIG. 3, which is a cross section taken along the line X—X in FIG. 2, shows the location of the embossing 22. The sheet metal jacket 11 has two opposite embossings which engage the bottom of the circular or ring slot 17 of the magnetic core 16 and thereby make a firm connection from the magnetic core to the coil form 12. The through-hole 13 can also be seen in FIG. 3.

FIG. 4 shows a view of the end face of the device shown in FIG. 2 on the armature side, from which it can be seen that the sheet metal jacket 11 has a total of four embossings 23 which are disposed in mutually opposite pairs and are shifted 90° relative to each other. The tripping part 25 as well as the dog 26 can pass unimpeded through the opening in the coil form 12 which is narrowed by the embossings 23, while the main part of the spring-loaded magnetic armature 14 rests against the embossings 23.

FIG. 5 shows an elevational view of a pressure or thrust washer 30 which is approximately circular and has a central hole 32. Two projections 34 are formed symmetrically to the center of the pressure washer 30 in the form of involutes. Two mutually opposite notches 35 are provided between the projections 34, which serve for handling the pressure washer 30. A security dog or pin 36 is formed between a notch 35 and a nose or projection 34 on one side of the pressure washer 30.

FIG. 6 shows the pressure washer 30 of FIG. 5 in a side view, from which the position and form of the safety dog 36 can be seen. End faces of a projection 34 and a notch 35 are also shown.

FIG. 7 shows an assembly of a magnetic tripping device 40 according to the invention which, contrary to the magnetic tripping device 10 of FIG. 1, additionally includes an inserted pressure or thrust washer 30. A magnetic yoke 20 accepts a coil form 12, around which a magnet winding 13 is placed. One end face of the coil form 12 is connected through the non-illustrated magnetic core to the magnetic yoke 20, since the post 15 is riveted to a leg 42 of the yoke resting against the coil form 12. The other end of the coil form 12 which is provided with radial embossings in the same manner as can be seen in FIGS. 2 and 4, is brought through a close fitting hole in a leg 41 of the magnetic yoke 20. In addition, in the FIG. 7 device, the pressure washer 30 is brought axially over the tripping part 25 and the dog 26 until it rests flush against the leg 41 of the magnetic yoke 20 and is locked with the magnetic yoke 20 in the manner of a bayonet lock, by a slight rotation about the axis of the hole 32 which is aligned with the longitudinal axis of the magnetic armature 14.

The projections 34 engage behind bayonet-type ring straps 38 which are curved out of the plane of the legs in the form of hooks. During the above-mentioned rotation of the pressure washer 30, the securing dog 36 snaps into a hole 37 which is provided for this purpose in the leg 41.

FIG. 8 shows a view of the end face of the assembly of the magnetic tripping device 40 of FIG. 7. The pressure washer 30 almost completely covers the leg 41 of the magnetic yoke 20. The tripping part 25 can pass through the hole 32 without making contact. The projections 34 of the pressure washer 30 are covered by the bayonet straps 38. The projections 34 are placed behind the straps by rotation of the pressure washer 30. The securing cam 36 engages the hole 37 provided for this purpose in the leg 41 and serves as antirotation means for the pressure washer 30.

FIG. 9 is a longitudinal section through a coil form 12, the construction of which, i.e. the shape and components, are identical with the coil form shown in FIG. 2, with one exception. This exception relates to the shape of the form-locking stroke limitation for the axially movable magnetic armature 14. A form-locking connection is one which is accomplished by the shape of the parts themselves, as opposed to a force-locking connection requiring external force. In contrast to the embossing shown in FIG. 2 at the end of the sheet metal jacket 11 of the coil form 12, the corresponding end of the jacket 11 in FIG. 9 is flanged over, throughout the entire periphery thereof. The annular flange designated with reference numeral **23*a* is provided in such a manner that the pin-shaped dog 26 of the magnetic armature 14 penetrates the remaining cross section of the opening unimpeded, while the magnetic armature 14** itself strikes the flange.

During the assembly, the coil form 12 which is shaped in this manner is inserted into the magnetic yoke 20 in the same manner as with the device shown in FIG. 2, while the flange is braced against the yoke.

The operation of the assembly of the magnetic tripping devices 10, 40 according to FIG. 1 and FIG. 7 is identical. The movably guided magnetic armature 14 is removed from the magnetic core 16 by means of the compression spring 28. The embossings 22, 23 are provided on the jacket of the coil form 12 for limiting the stroke on one hand and for fixing the position of the magnetic core on the other hand. The tripping part 25 is in connection with a non-illustrated tripping lever of an electrical wiring device. If current flows through the magnet coil 13, a magnetic field is developed in the coil form 12 which attempts to move the magnetic armature 14 against the spring force toward the magnetic core 16. The spring force is chosen in such a way that the magnetic armature 14 compresses the compression spring only when exceeding a given current which causes a magnetic field with a corresponding magnetic force and when the armature slides in the direction toward the magnetic core 16 and acutates the tripping lever with its tripping part 25. According to the invention, it is possible to construct the tripping device 40 for larger currents without having to expect damage due to breakage of the coil form 12. This is done by using a stronger compression spring 28 in connection with the pressure washer 30 or by means of the flange **23*a* which rests against the leg 41 of the magnetic yoke 20** and is braced against the yoke.

The foregoing is a description corresponding in substance to German Application No. P 35 15 530.1, dated Apr. 30, 1985, the International priority of which is being claimed for the instant application, and which is hereby made part of this application. Any material discrepancies between the foregoing specification and the aforementioned corresponding German application are to be resolved in favor of the latter.

We claim:

1. Magnetic tripping device for an electrical wiring device, comprising a U-shaped magnetic yoke, a cylindrical non-magnetic coil form having two end surfaces and a periphery and being disposed in said magnetic yoke, a magnetic core disposed in said coil form, a magnetic armature movably disposed in said coil form with a sliding fit, and a compression spring disposed in said coil form between said magnetic core and said magnetic armature, said coil form having means in the form of at least two radial embossings uniformly distributed over said periphery in the vicinity of said end surfaces for fixing said magnetic core in place in said coil form and for guiding said magnetic armature in said coil form with a limited stroke, said compression spring having a given positioning force acting on said magnetic armature for a tripping current intensity of a given magnitude, and including a pressure washer disposed outside said coil form and locked to said magnetic yoke for absorbing part of said positioning force and conducting forces transmitted by said magnetic armature to said magnetic yoke.

2. Magnetic tripping device according to claim 1, wherein said embossing is an annular flange.

3. Magnetic tripping device according to claim 1, wherein said magnetic core has a circular slot formed therein in which said at least one embossing is engaged.

4. Magnetic tripping device according to claim 1, wherein said magnetic yoke has a leg with a recess formed therein, and said magnetic core has a first end surface with a central guide hole formed therein for receiving said compression spring and a second end surface opposite said first surface having a post formed thereon retained in said recess.

5. Magnetic tripping device according to claim 1, wherein said magnetic armature has a first end surface having a step formed therein forming a pin, a circular disc integral with said pin forming a tripping part, and a second end surface opposite said first end surface having a recess formed therein for receiving said compression spring, said compression spring having a positioning force matched to a given tripping current intensity for the magnetic tripping device.

6. Magnetic tripping device according to claim 4, wherein said magnetic armature has a first end surface having a step formed therein forming a pin, a circular disc integral with said pin forming a tripping part, and a second end surface opposite said first end surface having a recess formed therein for receiving said compression spring, said compression spring having a positioning force matched to a given tripping current intensity for the magnetic tripping device.

7. Magnetic tripping device according to claim 5, wherein said magnetic yoke has a leg in the vicinity of said magnetic armature, said coil form has an end surface in the vicinity of said magnetic armature, and said pressure washer rests directly against said end face flush with said leg and has a hole formed therein through which said tripping part projects from said coil form.

8. Magnetic tripping device according to claim 7, wherein said leg has two bayonet catches formed thereon, and said pressure washer has two radial projections formed thereon engaging behind said bayonet catches upon rotation of said pressure washer about the longitudinal axis of said hole formed therein, forming a bayonet latch.

9. Magnetic tripping device according to claim 7, wherein said pressure washer is a circular disc with mutually parallel planar surfaces and said cutout is substantially centered in said disc.

10. Magnetic tripping device according to claim 8, wherein said pressure washer is a circular disc with mutually parallel planar surfaces and said cutout is substantially centered in said disc.

11. Magnetic tripping device according to claim 8, wherein said pressure washer has a safety dog formed on at least one surface thereof engaging in a recess formed in said leg of said magnetic yoke when said pressure washer is latched to said magnetic yoke.

* * * * *